United States Patent [19]

Gaskell

[11] Patent Number: 4,836,454

[45] Date of Patent: Jun. 6, 1989

[54] FUEL INJECTION NOZZLES

[75] Inventor: David J. Gaskell, Sudbury, England

[73] Assignee: Lucas Industries Public Limited Company, Birmingham, England

[21] Appl. No.: 169,329

[22] Filed: Mar. 17, 1988

[30] Foreign Application Priority Data

Mar. 21, 1987 [GB] United Kingdom ..... 8706757

[51] Int. Cl.[4] ..... F02M 47/00

[52] U.S. Cl. ..... 239/533.9

[58] Field of Search ..... 239/533.3–533.12

[56] References Cited

U.S. PATENT DOCUMENTS

| | | | |
|---|---|---|---|
| 3,343,798 | 9/1967 | Senft | 239/533.3 |
| 3,718,283 | 2/1973 | Fenne | 239/533.9 |
| 4,096,999 | 6/1978 | Eckert et al. | 239/533.5 |
| 4,202,500 | 5/1980 | Keiczek | 239/533.3 |
| 4,537,359 | 8/1985 | Skinner | 239/533.6 |
| 4,591,100 | 5/1986 | Gaskell et al. | 239/533.3 |

FOREIGN PATENT DOCUMENTS

| | | | |
|---|---|---|---|
| 3611316 | 10/1987 | Fed. Rep. of Germany | 239/533.5 |

*Primary Examiner*—Andres Kashnikow
*Assistant Examiner*—Michael J. Forman
*Attorney, Agent, or Firm*—Balogh, Osann, Kramer, Dvorak, Genova & Traub

[57] ABSTRACT

A fuel injection nozzle of the inwardly opening type includes a valve member which is biased into contact with a seating by a spring. The valve member is surrounded in part by a sleeve and both the valve member and sleeve are subject to fuel pressure so that axial forces are produced which act in opposition to the spring. When the forces are large enough the valve member and sleeve move but the sleeve movement and hence the movement of the valve member, is limited by a stop. Fuel is allowed to flow through an outlet at a restricted rate and only when the fuel pressure rises is the valve member moved further to allow unrestricted flow of fuel. The further movement of the valve member is limited by the engagement of an abutment on the valve member with the end of the sleeve.

8 Claims, 3 Drawing Sheets

FUEL INJECTION NOZZLES

FUEL INJECTION NOZZLES

This invention relates to a fuel injection nozzle for supplying fuel to an internal combustion engine, the nozzle being of the kind comprising a valve member which is movable axially by fuel under pressure supplied through a fuel inlet, away from a seating to permit fuel flow from the inlet to an outlet, the valve member being slidable within a sleeve which is itself axially slidable in a bore in a nozzle body and is subject to the fuel pressure at said inlet, a spring abutment engagable by the valve member, a coiled compression spring engaging said spring abutment for biasing the valve member into contact with the seating, said sleeve also being engageable with the spring abutment whereby when fuel under pressure is supplied through said inlet the force produced by the fuel pressure acting on the sleeve will assist the movement of the valve member against the action of the spring, first stop means for limiting the movement of the sleeve under the action of fuel pressure and second stop means for limiting the movement of the valve member under the action of fuel pressure.

In our co-pending European Application No. 88300597.7 there is described a fuel injection nozzle of the aforesaid kind in which the second stop means comprises a stop member which is engageable with the spring abutment. The stop member is in the form of a rod which is adjustably mounted in a holder to which the nozzle body is secured. The rod in fact extends within the coils of the spring which forms the resilient means. The provision of this form of stop adds to the expense of manufacturing the nozzle. It is therefore an object of the invention to provide a fuel injection nozzle of the kind set forth in a simpler form.

According to the invention in a fuel injection nozzle of the kind specified the second stop means comprises abutment means on the valve member for engagement with the sleeve, said abutment means in use, engaging with the sleeve to limit further movement of the valve member away from the seating after the movement of the sleeve has been arrested by the first stop means.

Figure 1:
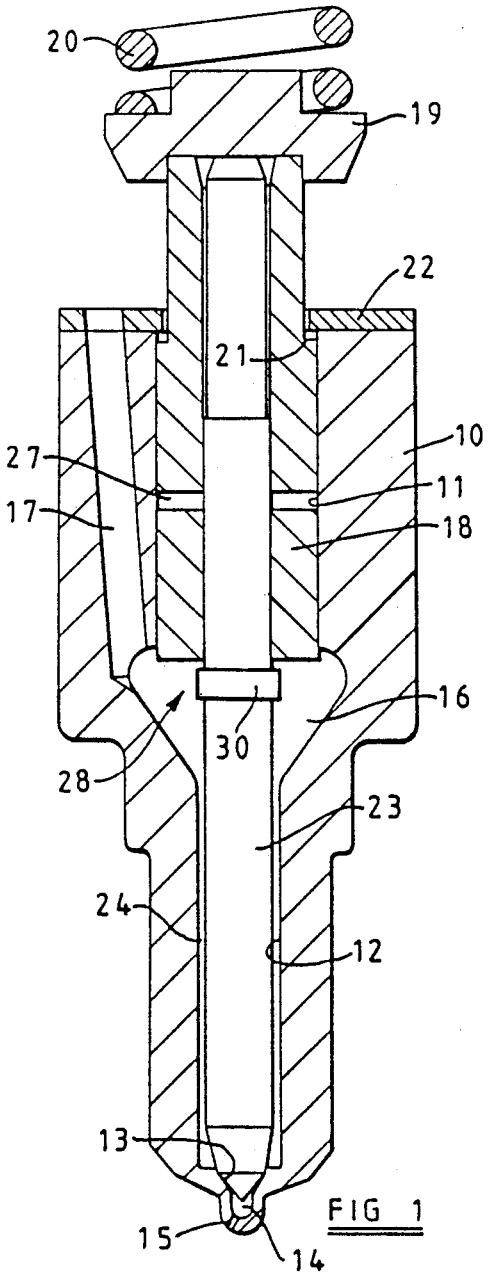
Figure 2:
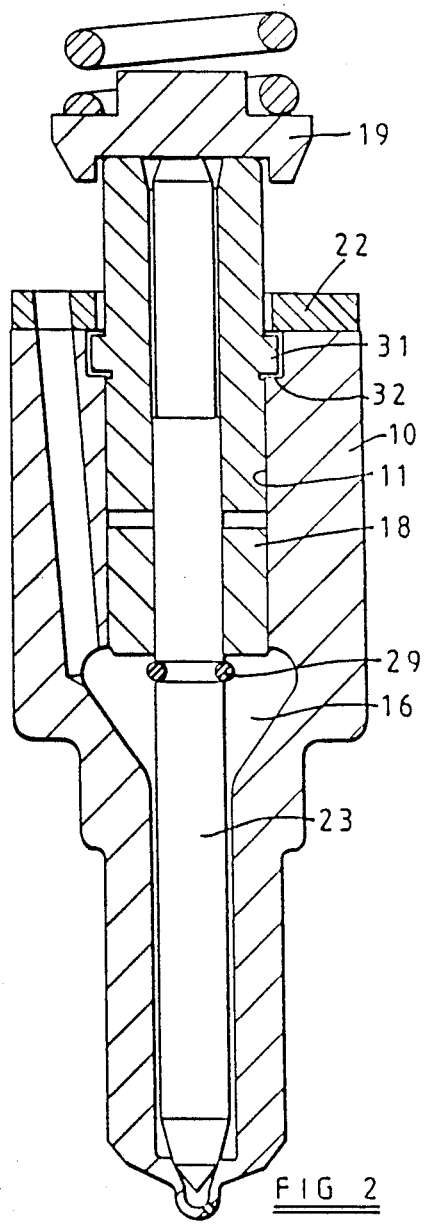
Figure 3:
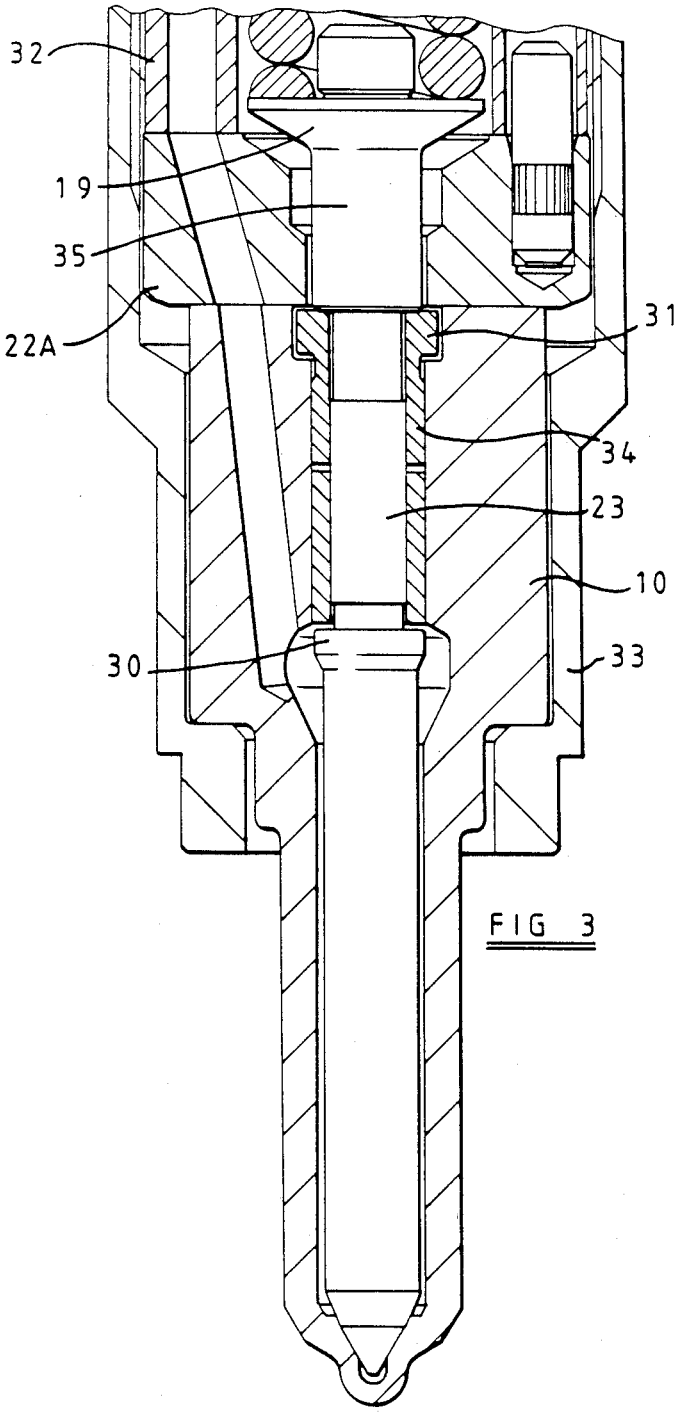
Figure 4:
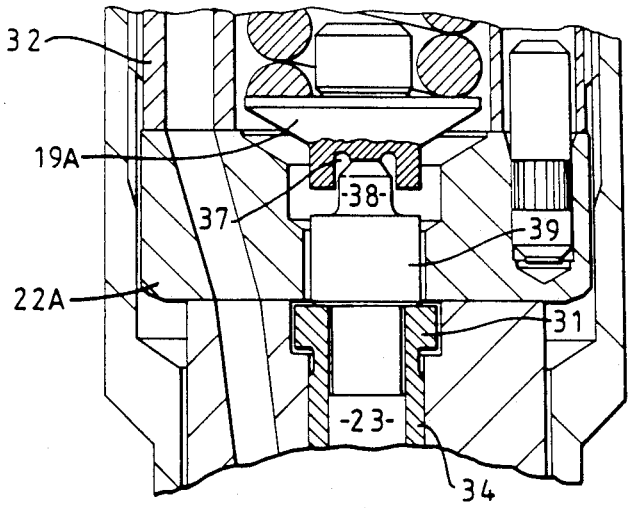

In the accompanying drawings:

FIGS. 1, 2 and 3 are sectional side elevations of three examples of nozzle respectively, and FIG. 4 is a modification of part of the nozzle of FIG. 3.

Referring to FIG. 1 of the drawings the nozzle comprises a stepped body 10 in which is formed a stepped bore 11 the narrower portion thereof being indicated at 12. At the end of the portion 12 of the bore remote from the portion 11 there is formed a seating 13 and below the seating there is defined a so-called "sac" 14 from which extends an outlet orifice 15. Intermediate the portions 11 and 12 of the bore there is formed an enlargement 16 which communicates by way of a supply passage 17 with a fuel inlet which is formed in a holder not shown to which the body 10 is secured in known manner, by means of a cap nut.

Slidably mounted within the portion 11 of the bore is a sleeve 18 which extends from the bore and locates within a spring abutment 19 against which bears one end of a coiled compression spring 20, the spring and the abutment together with the extension of the sleeve being located within a chamber formed in the aforesaid holder. The sleeve defines a peripheral step 21 for abutment in the particular example, with a stop plate 22 which is sandwiched between the nozzle body and the holder. The stop plate may however be constituted by the end face of the aforesaid holder.

Slidably mounted within the sleeve is a valve member 23 which is shaped for co-operation with the seating and which adjacent the seating has a tapered portion. The valve member defines a clearance 24 with the portion 12 of the bore so that fuel can flow from the enlargement 16 through the outlet orifice 15 when the valve member is lifted from its seating. It will be noted that the valve member throughout most of its length is of plain cylindrical form, the diameter of the valve member being slightly reduced at its end portion remote from the seating which end portion is engaged by the spring abutment 19. The sleeve is provided with apertures 27 extending between the inner and outer peripheral surfaces of the sleeve to try to ensure that in use, the fuel pressure which exists in the working clearances defined between the sleeve and the bore 11 and between the valve member 23 and the inner surface of the sleeve, are substantially equal.

In operation, when fuel under pressure is supplied to the enlargement 16, the pressure will act upon the end area of the sleeve 18 and also upon the annular area of the valve member which lies outside the seating. The forces produced by the fuel under pressure acting upon the aforesaid areas oppose the action of the spring and when the forces become sufficient, the valve member and the sleeve will move against the action of the spring thereby lifting the valve member from its seating to allow fuel to flow through the outlet orifice 15. As soon as the valve member is lifted from its seating an increased area thereof is exposed to fuel under pressure with the result that the valve member and the sleeve will move upwardly until the step 21 on the sleeve engages the stop plate 22. When this occurs no further movement of the sleeve is possible. The fuel flow through the orifice 15 is at a controlled rate, the gap between the valve member and the seating constituting a restriction to fuel flow. However, as the pressure in the inlet passage 17 continues to increase, a pressure will be reached at which the force developed on the valve member alone is sufficient to move the valve member against the action of the spring 20. The additional movement of the valve member 23 to its fully open position is determined by the abutment of an abutment means generally indicated at 28, on the valve member with the end of the sleeve 18. The additional movement allowed of the valve member is sufficient to allow substantially unrestricted flow of fuel through the outlet orifice 15. When the pressure of the fuel delivered to the injection nozzle falls, the valve member and the spring will return under the action of the spring 20 to the positions shown in the drawing.

FIG. 1 shows abutment means 28. The abutment means is in the form of a collar 30 which is integrally formed with the valve member. The collar may however be formed by a ring which is pressed against a step defined by a slightly enlarged lower portion of the valve member. FIG. 2 shows an alternate abutment means constituted by a circlip 29 which is located within a groove formed in the valve member.

The maximum movement of the valve member is therefore determined by the clearance between the step 21 and the plate 22 or holder added to the clearance between the abutment means 28 and the end of the sleeve 18. The limited movement of the valve member is determined by the gap between the step 21 and the plate 22 when the sleeve 18 is in engagement with the abutment 19.

When the engine has been halted for a considerable length of time, it can be expected that the fuel pressure in the enlargement 16 will fall to zero and in this situation it is possible for the sleeve 18 to fall under the action of gravity into the enlargement 16. However, the aforesaid abutment means 28 limits the extent of movement of the sleeve in this manner. Moreover, it arrests the motion of the sleeve 18 when it is returned by the action of the spring.

In the example shown in FIG. 2, the extent of movement of the sleeve in one direction is determined by the abutment of a flange 31 on the sleeve with a stop plate 22 and in the other direction by the abutment of the flange 31 with a step 32 which is defined by an enlarged portion of the bore 11. In this case therefore the abutment means 28 which as shown in the form of a circlip 29, does not act to restrain the downward movement of the sleeve 18.

FIG. 3 shows a practical embodiment of the nozzle. The stop plate is in the form of a distance piece 22A which is sandwiched between the nozzle body 10 and the holder 32. Also shown is the cap nut 33 which serves to secure the nozzle body the distance piece 22A and the holder 32 in assembly.

The sleeve 34 is provided with the flange 31 of the example of FIG. 2 but in this case the spring abutment 19 has an extension 35 which extends with clearance through the distance piece 22a. The valve member 23 and the sleeve in the closed position of the valve member, lie below the adjacent end surface of the nozzle body. The first stage of lift of the valve member 23 which is critical can therefore be adjusted by initial measurement with the valve member in the closed position, of the gap between the end of the valve member and the end surface of the body followed by grinding of the end of the valve member or the body to give the desired lift. The second stage of lift of the valve member which is less critical, can be adjusted by selecting a sleeve of the correct length.

In the modification shown in FIG. 4 the spring abutment 19A defines a recess 37 in which there is located the reduced end portion 38 of an intermediate piece 39 which can be engaged by the end surface of the sleeve 34 and the end of the valve member 23. The fact that the abutment and intermediate piece are separate items allows for correct alignment of the intermediate piece with the sleeve and valve member.

I claim:

1. A fuel injection nozzle for supplying fuel to an internal combustion engine comprising a valve member movable axially by fuel under pressure supplied through a fuel inlet, away from a seating to permit fuel flow from the inlet to an outlet, the valve member being slidable within a sleeve, and subject to the fuel pressure at said inlet, the sleeve being slidable in a bore in a nozzle body, a spring abutment engageable by the valve member, a coiled compression spring engaging the spring abutment for biasing the valve member into contact with the seating, the sleeve also being engageable with the spring abutment whereby when fuel under pressure is supplied through said inlet the force produced by the fuel pressure acting on the sleeve will cause the sleeve to engage the spring abutment to assist the movement of the valve member against the action of the spring, stop means for limiting the movement of the sleeve under the action of fuel pressure and abutment means on the valve member for engaging with the sleeve to limit further movement of the valve member away from the seating after the movement of the sleeve has been arrested by the stop means.

2. A fuel injection nozzle according to claim 1 in which said stop means comprises a stop plate located against the end of the nozzle body said stop plate being engageable by a surface on said sleeve.

3. A fuel injection nozzle according to claim 1 in which said abutment means comprises a collar formed on the valve member.

4. A fuel injection nozzle according to claim 1 in which said abutment means comprises a ring retained upon the valve member.

5. A fuel injection nozzle according to claim 4 in which said ring is located against a step defined on the valve member.

6. A fuel injection nozzle according to claim 2, in which said abutment means comprises a collar formed on the valve member.

7. A fuel injection nozzle according to claim 2 in which said abutment means comprises a ring retained upon the valve member.

8. A fuel injection nozzle according to claim 7 in which said ring is located against a step defined on the valve member.

* * * * *